US011365631B2

(12) United States Patent
Chiba et al.

(10) Patent No.: US 11,365,631 B2
(45) Date of Patent: Jun. 21, 2022

(54) TURBINE ROTOR BLADE AND TURBINE

(71) Applicant: MITSUBISHI HEAVY INDUSTRIES ENGINE & TURBOCHARGER, LTD., Sagamihara (JP)

(72) Inventors: Takeru Chiba, Tokyo (JP); Toru Hoshi, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 13 days.

(21) Appl. No.: 17/251,034

(22) PCT Filed: Nov. 29, 2018

(86) PCT No.: PCT/JP2018/043984

§ 371 (c)(1),
(2) Date: Dec. 10, 2020

(87) PCT Pub. No.: WO2020/110257

PCT Pub. Date: Jun. 4, 2020

(65) Prior Publication Data

US 2021/0172320 A1 Jun. 10, 2021

(51) Int. Cl.

| | |
|---|---|
| ***F01D 5/04*** | (2006.01) |
| ***F01D 5/02*** | (2006.01) |
| ***F01D 5/14*** | (2006.01) |

(52) U.S. Cl.

CPC ..... *F01D 5/025* (2013.01); *F01D 5/048* (2013.01); *F01D 5/141* (2013.01); *F05D 2220/40* (2013.01)

(58) Field of Classification Search

CPC . F01D 5/048; F01D 5/141; F01D 5/14; F01D 5/025; F04D 29/30

See application file for complete search history.

(56) References Cited

U.S. PATENT DOCUMENTS 6,942,460 B2 * 9/2005 Osako ..... F02B 39/00 416/185
9,777,578 B2 * 10/2017 Yokoyama ..... F01D 5/04
(Continued)

FOREIGN PATENT DOCUMENTS

CN 202431307 U 9/2012
EP 2 940 271 A1 11/2015
(Continued)

OTHER PUBLICATIONS

Extended European Search Report for corresponding European Application No. 18941516.9. dated May 26, 2021.

*Primary Examiner* — Woody A Lee, Jr.
*Assistant Examiner* — Behnoush Haghighian
(74) *Attorney, Agent, or Firm* — Birch, Stewart, Kolasch & Birch, LLP

(57) ABSTRACT

A turbine rotor blade according to at least one embodiment to be connected to a rotational shaft so as to be rotatable around an axis includes a hub having a hub surface inclined with respect to the axis in a cross-section along the axis; and a plurality of rotor blades disposed on the hub surface. In a throat portion where a blade-to-blade distance between two adjacent rotor blades is smallest, a value (Lt/r) obtained by dividing the blade-to-blade Lt at a given radial position by a distance r from the axis to the radial position is maximum at a position where a dimensionless span length is in a range of 0.2 to 0.65, assuming that the dimensionless span length is 0 at a position of a root end portion on a hub side and is 1 at a position of a tip end portion opposite to the hub side.

10 Claims, 8 Drawing Sheets

(56) References Cited

U.S. PATENT DOCUMENTS

| | | | | |
|---|---|---|---|---|
| 11,215,057 | B2 * | 1/2022 | Yoshida | F01D 5/141 |
| 2004/0115044 | A1 * | 6/2004 | Osako | F01D 5/048<br>415/143 |
| 2015/0330226 | A1 * | 11/2015 | Yokoyama | F01D 25/24<br>416/235 |

FOREIGN PATENT DOCUMENTS

| | | | |
|---|---|---|---|
| JP | 9-100701 | A | 4/1997 |
| JP | 2003-201802 | A | 7/2003 |
| JP | 2011-117344 | A | 6/2011 |
| JP | 2011-132810 | A | 7/2011 |

* cited by examiner

TURBINE ROTOR BLADE AND TURBINE

TECHNICAL FIELD

The present disclosure relates to a turbine rotor blade and a turbine.

BACKGROUND

In an engine used for automobiles or the like, in order to improve the output of the engine, an exhaust turbocharger is widely known in which a turbine is rotated by energy of exhaust gas of the engine, and intake air is compressed by a centrifugal compressor connected to the turbine via a rotational shaft, and is supplied to the engine.

An example of the turbine used for such an exhaust turbocharger is disclosed in Patent Document 1.

CITATION LIST

Patent Literature

Patent Document 1: JP2003-201802A

SUMMARY

Problems to be Solved

This type of turbine has a plurality of blades radially arranged on the outer periphery of the hub, for example, as shown in Patent Document 1.

An exhaust turbocharger used for automobiles or the like is relatively small and has a wide operating range and a high rotational speed. Accordingly, a turbine used for such an exhaust turbocharger needs to increase the blade thickness on the hub side. As a result, the distance between blades is narrow, so that it difficult to increase the number of blades. Further, a turbine of an exhaust turbocharger used for automobiles or the like is required to have good transient response. Accordingly, the number of blades tends to be reduced in order to suppress the moment of inertia.

When the number of blades is reduced, the blade-to-blade distance between two adjacent blades increases, so that the blade-to-blade distance also increases in the throat portion where the blade-to-blade distance is the smallest.

In a radial inflow turbine, the loss tends to increase on the tip end portion side (tip side) of the blade. Accordingly, when the blade-to-blade distance on the tip side of the throat portion increases, the flow rate of a working fluid (exhaust gas) on the tip side increases, and the loss increases.

The throat portion is formed between a certain chordwise position (hereinafter, also referred to as first position) of one of two adjacent rotor blades and a certain chordwise position (hereinafter, referred to as second position) of the other rotor blade.

When the number of blades is reduced as described above, the difference in chordwise position between the first position of one rotor blade and the second position of the other rotor blade that form the throat portion tends to increase. Since the blade angle generally varies with the position in the chordwise direction, when the number of blades is reduced as described above, the difference in chordwise position between the first position and the second position increases, so that the difference between the blade angle at the first position and the blade angle at the second position, i.e., the difference between the blade angle of one rotor blade and the blade angle of the other rotor blade in the throat portion tends to increase.

When the difference between the blade angle of one rotor blade and the blade angle of the other rotor blade in the throat portion increases, the blade-to-blade distance increases significantly in the throat portion, in addition to the increase in blade-to-blade distance between two adjacent rotor blades due to the reduction in number of blades.

Accordingly, when the number of blades is reduced, the flow rate of a working fluid (exhaust gas) on the tip side further increases, and the loss further increases.

In view of the above, an object of at least one embodiment of the present invention is to suppress loss in the turbine by reducing the blade-to-blade distance on the tip side of the throat portion.

Solution to the Problems (1) A turbine rotor blade according to at least one embodiment of the present invention comprises: a hub having a hub surface inclined with respect to the axis in a cross-section along the axis; and a plurality of rotor blades disposed on the hub surface. In a throat portion where a blade-to-blade distance between two adjacent rotor blades of the plurality of rotor blades is smallest, a value (Lt/r) obtained by dividing the blade-to-blade Lt at a given radial position by a distance r from the axis to the radial position is maximum at a position where a dimensionless span length is in a range of 0.2 to 0.65, assuming that the dimensionless span length is 0 at a position of a root end portion on a hub side, and the dimensionless span length is 1 at a position of a tip end portion opposite to the hub side.

With the above configuration (1) since the value Lt/r in the throat portion is maximum at a position where the dimensionless span length is in a range of 0.2 to 0.65, it is possible to reduce the flow rate of a working fluid (exhaust gas) on the tip side, as compared with the case where the value Lt/r is maximum at a position where the dimensionless span length exceeds 0.65. Therefore, with the above configuration (1), it is possible to suppress loss in the turbine.

(2) A turbine rotor blade according to at least one embodiment of the present invention comprises: a hub having a hub surface inclined with respect to the axis in a cross-section along the axis; and a plurality of rotor blades disposed on the hub surface. When l is expressed by the following expression (1):

$$l = D \times \sin\{360/(n \times 2)\} \times \sin \beta \quad (1),$$

where β is a blade angle [degree] at a tip-side end of a trailing edge of each rotor blade, D is a diameter of the turbine rotor blade at the tip-side end, and n is the number of the rotor blades, a value (l/L) obtained by dividing l by a distance L between the tip-side end of the trailing edge and a tip-side end of a leading edge of the rotor blade ranges from 0.3 to 0.65.

In the above configuration (2), l corresponds to a distance between two points on a straight line described below. The straight line is a line that passes through a tip-side end of a trailing edge of one rotor blade and extends at the same angle as the blade angle at this tip-side end, when the rotor blade is viewed from the radially outer side. One of the two points is this tip-side end, and the other is an intersection between the straight line and a perpendicular line from a tip-side end of a trailing edge of another rotor blade adjacent to the suction side (suction surface) of the one rotor blade to the straight line.

In the configuration (2), the smaller the value represented by l/L, the closer the formation position of the throat portion to the trailing edge.

Therefore, with the above configuration (2), since the value represented by l/L ranges from 0.3 to 0.65, the formation position of the throat portion is closer to the trailing edge than when the value exceeds 0.65. When the formation position of the throat portion is close to the trailing edge, the difference in chordwise position between the first position of one rotor blade and the second position of the other rotor blade that form the throat portion decreases. As a result, the difference between the blade angle at the first position and the blade angle at the second position, i.e., the difference between the blade angle of one rotor blade and the blade angle of the other rotor blade in the throat portion decreases, so that the increase in blade-to-blade distance in the throat portion is suppressed.

Therefore, with the above configuration (2), it is possible to reduce the flow rate of a working fluid (exhaust gas) on the tip side. Thus, it is possible to suppress loss in the turbine.

(3) In some embodiments, in the above configuration (1) or (2), the plurality of rotor blades has a region where a blade angle is constant regardless of a position in a chordwise direction in a range between a trailing edge and a position away from the trailing edge toward a leading edge by a predetermined length along the chordwise direction.

In the case where the throat portion is formed close to the trailing edge of the rotor blade, by providing the region where the blade angle is constant regardless of the chordwise position in a range between the trailing edge and a position away from the trailing edge toward the leading edge by a predetermined length along the chordwise direction as with the configuration (3), it is possible to reduce the difference between the blade angle of one rotor blade and the blade angle of the other rotor blade in the throat portion, as compared with the case where this region is not provided. Therefore, with the above configuration (3), it is possible to suppress an increase in blade-to-blade distance in the throat portion and reduce the flow rate of a working fluid (exhaust gas) on the tip side. Thus, it is possible to suppress loss in the turbine.

(4) In some embodiments, in any one of the above configurations (1) to (3), the number of the rotor blades is not more than 12.

As described above, when the number of blades is reduced, the blade-to-blade distance between two adjacent blades increases, so that the blade-to-blade distance also increases in the throat portion where the blade-to-blade distance is the smallest. Further, as the number of blades is reduced, the load applied on one rotor blade increases, and the flow rate of a working gas increases, so that the influence of the leak flow on the tip side relatively increases.

In this regard, with the above configuration (4), since the turbine has, in addition to the configuration of any one of the above (1) to (3), a relatively small number of, namely 12 or less, rotor blades, the effect of suppressing loss by the configuration of any one of the above (1) to (3) is remarkable.

(5) A turbine according to at least one embodiment of the present invention comprises: the turbine rotor blade according to any one of the above (1) to (4); and a casing rotatably accommodating the turbine rotor blade.

With the above configuration (5), since the turbine rotor blade described in any one of the above (1) to (4) is included, it is possible to suppress loss in the turbine.

(6) In some embodiments, in the above configuration (5), the turbine further comprises a variable nozzle mechanism for adjusting a flow of a working fluid to the turbine rotor blade.

In a variable geometry turbine having the variable nozzle mechanism, the flow rate range of the working fluid is wide, and the number of blades is small, compared with a non-variable geometry turbine.

In this regard, with the above configuration (6), since the turbine rotor blade described in any one of the above (1) to (4) is included, the effect of suppressing loss in the turbine is remarkable.

Advantageous Effects

According to at least one embodiment of the present invention, it is possible to suppress loss in the turbine.

DETAILED DESCRIPTION

Embodiments of the present invention will now be described in detail with reference to the accompanying drawings. It is intended, however, that unless particularly identified, dimensions, materials, shapes, relative positions, and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
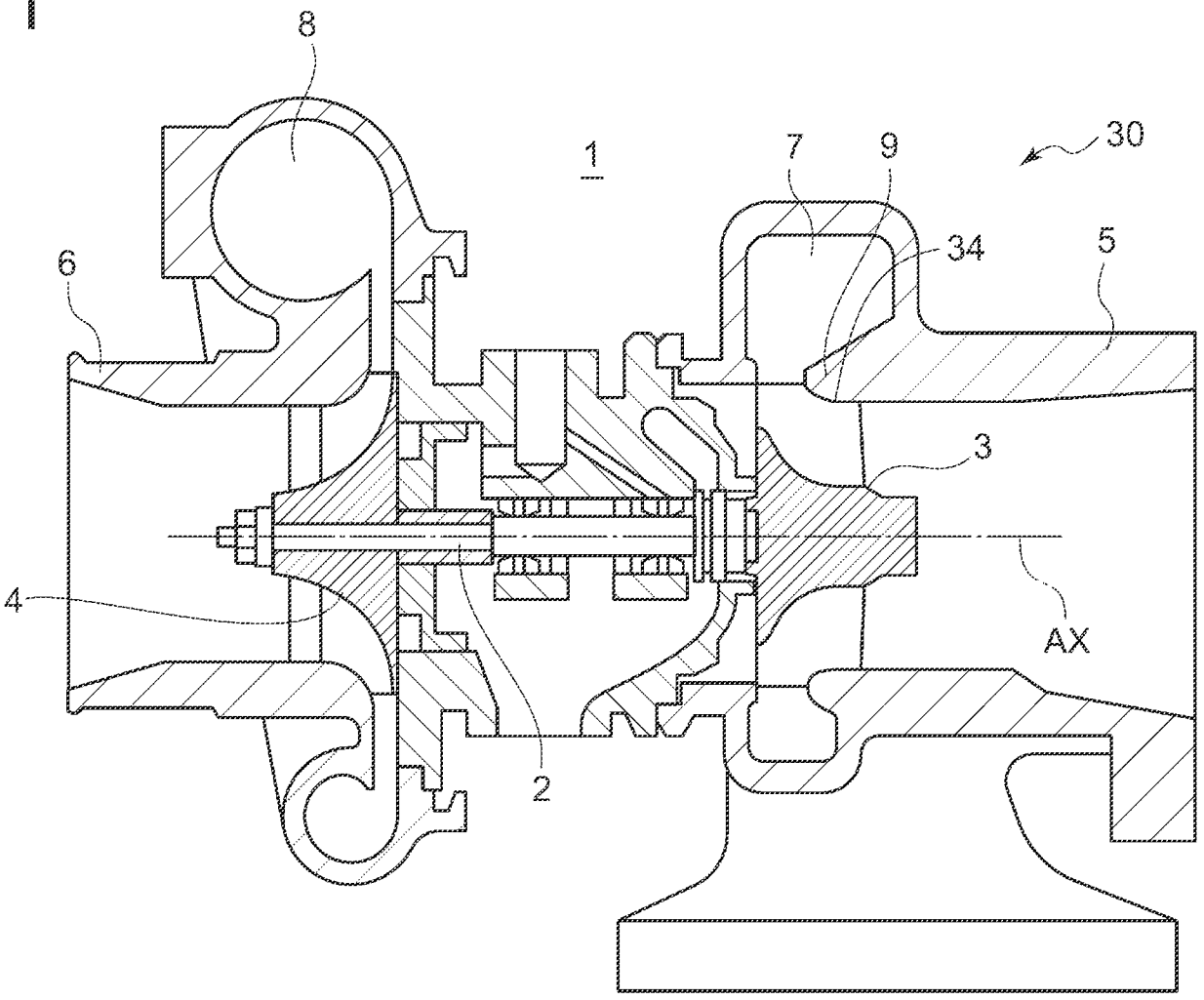
FIG. 1 is a cross-sectional view illustrating an example of a turbocharger according to some embodiments.

FIG. 1 is a cross-sectional view illustrating an example of a turbocharger 1 according to some embodiments.

The turbocharger 1 according to some embodiments is an exhaust turbocharger for supercharging air to an engine mounted on a vehicle such as an automobile.

The turbocharger 1 includes a turbine wheel (turbine rotor blade) 3 and a compressor wheel 4 which are connected via a rotor shaft 2 serving as a rotational shaft, a casing (turbine housing) 5 rotatably accommodating the turbine rotor blade 3, and a compressor housing 6 rotatably accommodating the compressor wheel 4. The turbine housing 5 has a scroll 7. The compressor housing 6 has a scroll 8.

On the outer peripheral side of the turbine rotor blade 3 of the turbine housing 5, a shroud 9 is formed so as to cover the turbine rotor blade 3. A turbine 30 according to some embodiments includes the turbine rotor blade 3 and the casing 5.

Figure 2:
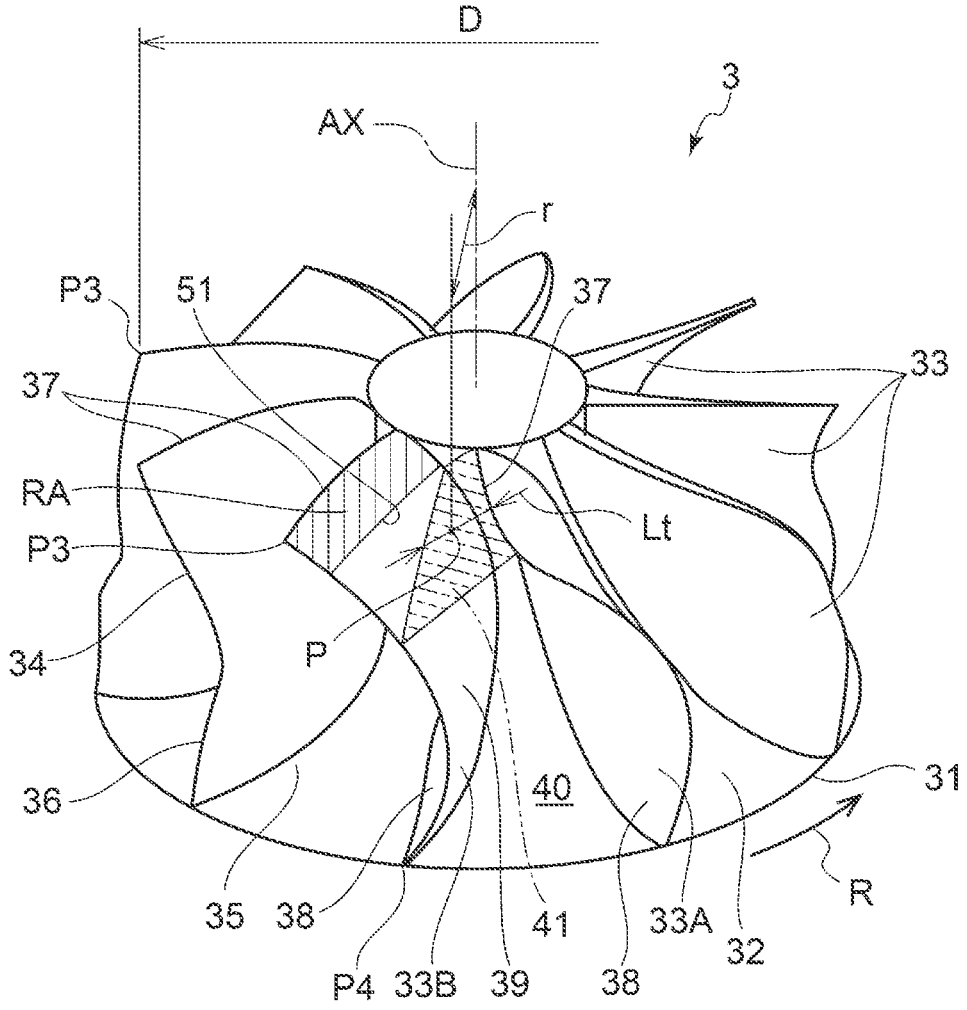
FIG. 2 is a perspective view of a turbine rotor blade according to some embodiments.

FIG. 2 is a perspective view of the turbine rotor blade 3 according to some embodiments.

The turbine rotor blade 3 according to some embodiments is connected to the rotor shaft (rotational shaft) 2 so as to be rotatable around an axis AX. The turbine rotor blade 3 according to some embodiments includes a hub 31 having a hub surface 32 inclined with respect to the axis AX in a cross-section along the axis AX and a plurality of rotor blades 33 arranged on the hub surface 32. Although the turbine rotor blade 3 shown in FIG. 2 is a radial turbine, it may be a mixed flow turbine. In FIG. 2, the arrow R indicates the rotation direction of the turbine rotor blade 3. The rotor blades 33 are arranged at intervals in the circumferential direction of the turbine rotor blade 3.

In the turbocharger 1 having this configuration, exhaust gas as a working fluid flows from a leading edge 36 to a trailing edge 37 of the turbine rotor blade 3.

An exhaust turbocharger, such as the turbocharger 1, used for automobiles or the like is relatively small and has a wide operating range and a high rotational speed. Accordingly, in the turbine rotor blade 3, it is necessary to increase the thickness of the rotor blade 33 on the hub 31 side. As a result, the distance between blades is narrow, so that it difficult to increase the number of the rotor blades 33. Further, a turbine of an exhaust turbocharger used for automobiles or the like is required to have good transient response. Accordingly, the number of the rotor blades 33 tends to be reduced in order to suppress the moment of inertia.

When the number of the rotor blades 33 is reduced, the blade-to-blade distance between two adjacent rotor blades 33 increases, so that the blade-to-blade distance also increases in the throat portion where the blade-to-blade distance is the smallest.

In a radial inflow turbine such as the turbine rotor blade 3, the loss tends to increase on the tip end portion 34 side (tip side) of the turbine rotor blade 3. Accordingly, when the blade-to-blade distance on the tip 34 side of the throat portion increases, the flow rate of a working fluid (exhaust gas) on the tip 34 side increases, and the loss increases.

The throat portion is formed between a certain chordwise position (hereinafter, also referred to as first position) of one of two adjacent rotor blades and a certain chordwise position (hereinafter, referred to as second position) of the other rotor blade. The chordwise direction is a direction along a line segment connecting the leading edge and the trailing edge of the blade.

That is, in the turbine rotor blade 3 according to some embodiments, for example as shown in FIG. 2, an inter-blade passage 40 is formed between a pressure surface 38 of one of two adjacent rotor blades 33, namely a rotor blade 33A, and a suction surface 39 of the other, namely a rotor blade 33B. Further, the inter-blade passage 40 has a throat portion 41 at which the blade-to-blade distance is the smallest. In FIG. 2, the throat portion 41 is a region hatched by the dashed-and-double-dotted line. In the turbine rotor blade 3 according to some embodiments, the throat portion 41 is defined by the trailing edge 37 of one rotor blade 33A and the suction surface 39 of the other rotor blade 33B of two adjacent rotor blades 33. In the turbine rotor blade 3 according to some embodiments, the first position is on the trailing edge 37 of one rotor blade 33A, and the second position is on the suction surface 39 of the other rotor blade 33B.

Figure 3:
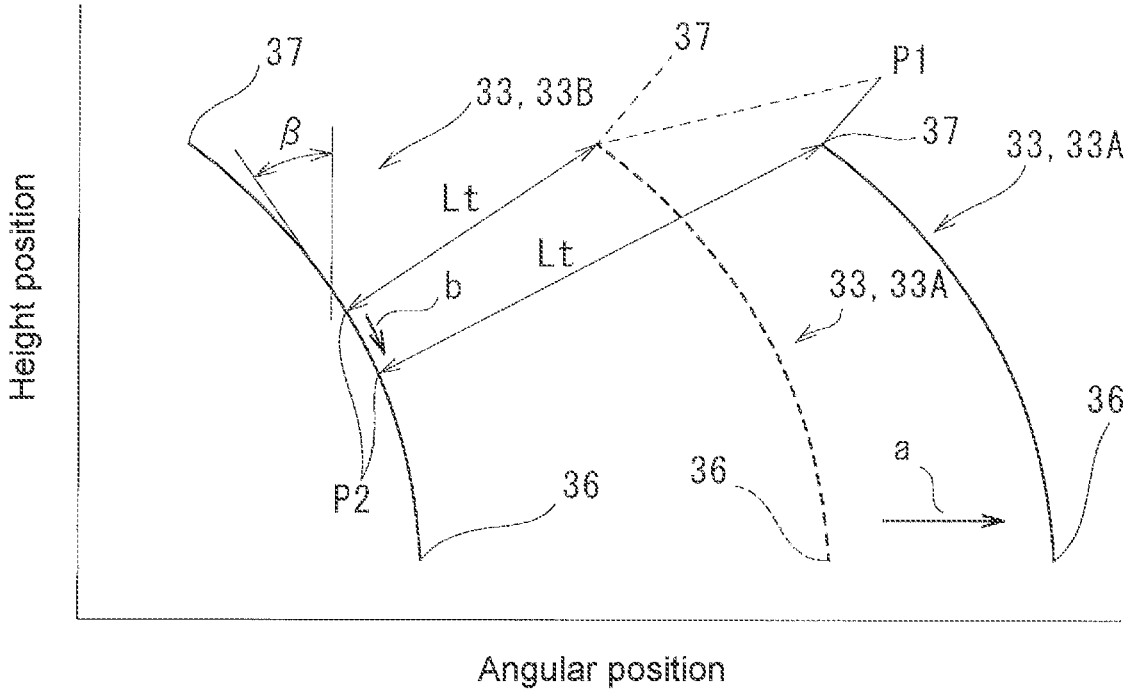
FIG. 3 is a circumferential development view of a tip end portion of a rotor blade, where the horizontal axis represents the angular position about the axis of the turbine rotor blade, and the vertical axis represents the height position along the axis of the turbine rotor blade.

FIG. 3 is a circumferential development view of the tip end portion 34 of the rotor blade 33, where the horizontal axis represents the angular position about the axis AX of the turbine rotor blade 3, and the vertical axis represents the height position along the axis AX of the turbine rotor blade 3. In FIG. 3, the rotor blade 33 is schematically depicted as a line along a camber line connecting the midpoints between the pressure surface 38 and the suction surface 39 of the rotor blade 33.

When the number of the rotor blades 33 is reduced, as shown in FIG. 3, the difference in chordwise position between the first position P1 of one rotor blade 33A and the second position P2 of the other rotor blade 33B that form the throat portion 41 (see FIG. 2) tends to increase.

For instance, as shown in FIG. 3, when the rotor blade 33A is moved from the angular position shown by the dashed line to the angular position shown by the solid line as indicated by the arrow a in a direction away from the rotor blade 33B, the second position P2 is moved toward the leading edge 36 on the suction surface 39 of the rotor blade 33A as indicated by the arrow b, while the first position P1 is still positioned on the trailing edge 37 of the rotor blade 33A.

Since the blade angle β generally varies with the position in the chordwise direction, when the number of the rotor blades 33 is reduced as described above, the difference in chordwise position between the first position P1 and the second position P2 increases, so that the difference between the blade angle β at the first position P1 and the blade angle β at the second position P2, i.e., the difference between the blade angle β of one rotor blade 33A and the blade angle β of the other rotor blade 33B in the throat portion 41 tends to increase.

The blade angle β is an angle β between the axis AX direction and the camber line at a given position of the rotor blade 33 when viewed from the radially outer side.

When the difference between the blade angle β of one rotor blade 33A and the blade angle β of the other rotor blade 33B in the throat portion 41 increases, the blade-to-blade distance Lt increases significantly in the throat portion 41, in addition to the increase in blade-to-blade distance between two adjacent rotor blades 33 due to the reduction in number of the rotor blades 33.

Accordingly, when the number of the rotor blades 33 is reduced, the flow rate of a working fluid (exhaust gas) on the tip end portion 34 side (tip side) further increases, and the loss further increases.

Therefore, in the turbine rotor blade 3 according to some embodiments, the rotor blade 33 is shaped such that the change amount of the blade angle β in response to the change amount of the chordwise position is sufficiently small in the vicinity of the trailing edge 37.

More specifically, in each rotor blade 33 of the turbine rotor blade 3 according to some embodiments, for example as shown in FIG. 2, a range between the trailing edge 37 and a position 51 away from the trailing edge 37 toward the leading edge 36 by a predetermined length along the chordwise direction is defined as a range RA. In the turbine rotor blade 3 according to some embodiments, the shape of the range RA is set so as to satisfy a condition described later.

When the rotor blade 33 is shaped such that the change amount of the blade angle β in response to the change amount of the chordwise position is sufficiently reduced in the vicinity of the trailing edge 37 by setting the shape of the range RA so as to satisfy the later-described condition, it is possible to suppress an increase in the blade-to-blade distance Lt in the throat portion 41 in addition to the increase in the blade-to-blade distance between two adjacent rotor blades 33 even when the blade-to-blade distance between the rotor blades 33 is increased due to a reduction in number of the rotor blades 33.

Figure 4:
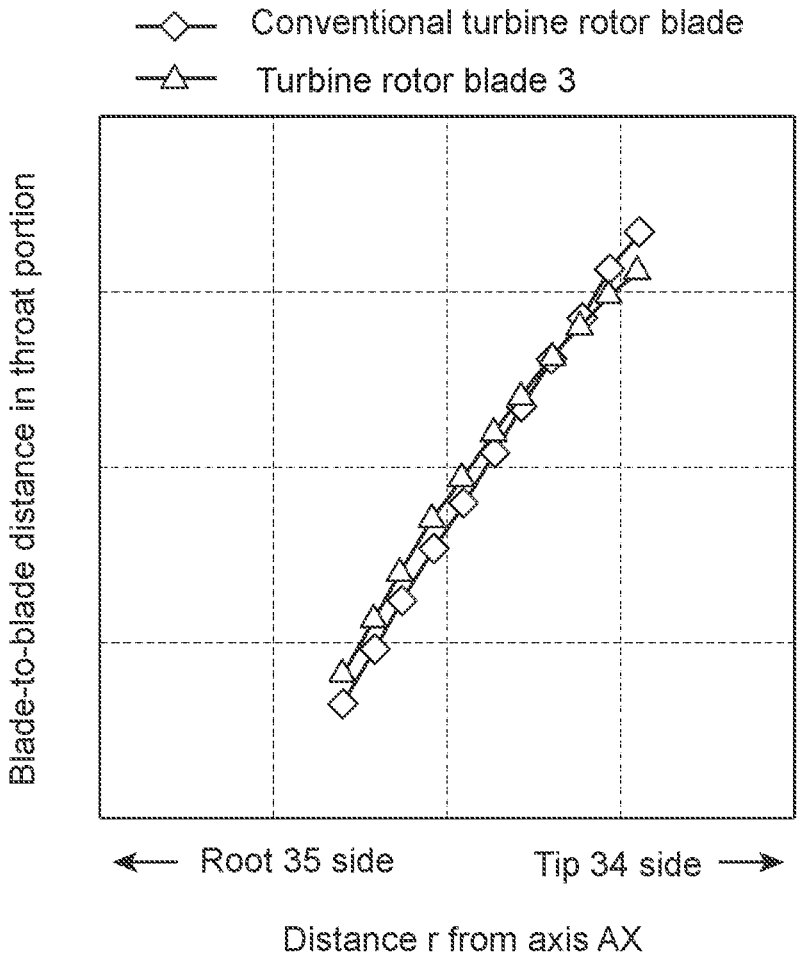
FIG. 4 is a diagram comparing the blade-to-blade distance in a throat portion of a conventional turbine rotor blade with the blade-to-blade distance in a throat portion of a turbine rotor blade according to some embodiments.

FIG. 4 is a diagram comparing the blade-to-blade distance in a throat portion of a conventional turbine rotor blade with the blade-to-blade distance Lt in the throat portion 41 of the turbine rotor blade 3 according to some embodiments. In FIG. 4, the vertical axis represents the blade-to-blade distance in the throat portion, and the horizontal axis represents the distance r from the axis AX. In FIG. 4, rectangular plots represent the blade-to-blade distance in the throat portion of the conventional turbine rotor blade, and the triangular plots represent the blade-to-blade distance Lt in the throat portion 41 of the turbine rotor blade 3 according to some embodiments.

The conventional turbine rotor blade of FIG. 4 includes the rotor blade having a shape in which the range RA is cut out from the turbine rotor blade 3 for example shown in FIG. 2. In other words, the turbine rotor blade 3 of FIG. 4 includes the rotor blade 33 having a shape in which a portion shown by the range RA is added to the trailing edge of the conventional turbine rotor blade.

Figure 5:
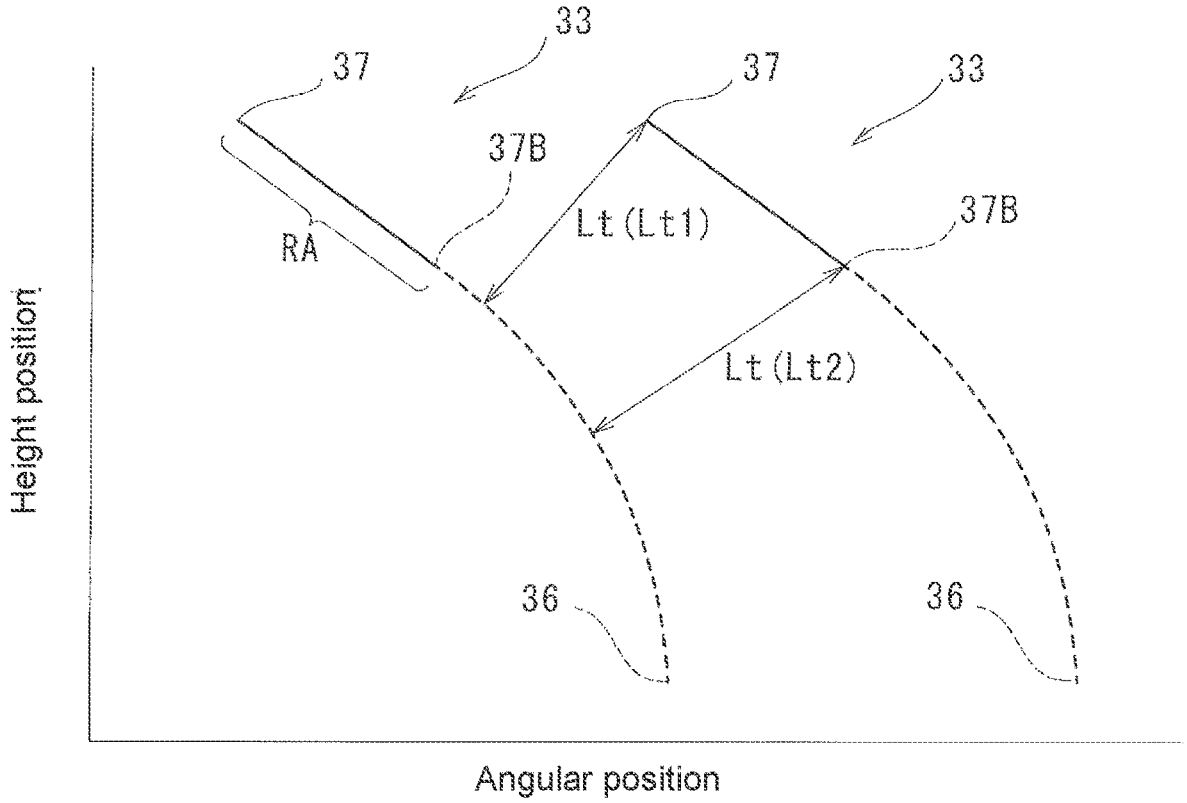
FIG. 5 is a circumferential development view of a tip end portion of a rotor blade, where the horizontal axis represents the angular position about the axis of the turbine rotor blade, and the vertical axis represents the height position along the axis of the turbine rotor blade.

FIG. 5 is a circumferential development view of the tip end portion 34 of the rotor blade 33, where the horizontal axis represents the angular position about the axis AX of the turbine rotor blade 3, and the vertical axis represents the height position along the axis AX of the turbine rotor blade 3. In FIG. 5, the rotor blade 33 is schematically depicted as a line along a camber line connecting the midpoints between the pressure surface 38 and the suction surface 39 of the rotor blade 33. In FIG. 5, the portion of the rotor blade 33 shown by the dashed line represents a portion corresponding to the rotor blade of the conventional turbine rotor blade, and the portion shown by the solid line is a portion of the range RA.

As shown in FIG. 5, when the portion of the range RA is added to the trailing edge 37B of the conventional rotor blade, the blade-to-blade distance Lt (Lt1) in the throat portion 41 becomes smaller than the blade-to-blade distance Lt (Lt2) in the throat portion of the conventional turbine rotor blade.

As shown in FIG. 4, at the tip end portion 34, the turbine rotor blade 3 according to some embodiments has a smaller blade-to-blade distance Lt in the throat portion 41 than the conventional turbine rotor blade. Thus, it is possible to reduce the flow rate of a working fluid (exhaust gas) at the tip end portion 34, and it is possible to suppress loss in the turbine 30.

Further, as described above, when the rotor blade 33 of the turbine rotor blade 3 has a shape in which the portion shown by the range RA is added to the trailing edge 37B of the conventional turbine rotor blade, it is possible to suppress loss in the turbine 30 without largely changing the shape of the rotor blade of the conventional turbine rotor blade. Thus, it is possible to reduce the cost required for the design of the shape of the rotor blade 33.

Hereinafter, the turbine rotor blade 3 according to some embodiments will be described in more detail.

For example, in the turbine rotor blade 3 according to some embodiments, the rotor blade 33 is shaped so as to satisfy the following condition in the throat portion 41 where the blade-to-blade distance between two adjacent rotor blades 33 is the smallest. Specifically, consider a value (Lt/r) obtained by dividing the blade-to-blade distance Lt at a given radial position P by a distance r from the axis AX to the radial position P in the throat portion 41 as shown in FIG. 2. In the turbine rotor blade 3 according to some embodiments, Lt/r is maximum at a position where a dimensionless span length is in a range of 0.2 to 0.65, when the dimensionless span length is 0 at the position of the root end portion 35 on the hub 31 side, and the dimensionless span length is 1 at the position of the tip end portion 34 opposite to the hub 31 side.

Thus, it is possible to reduce the flow rate of a working fluid (exhaust gas) on the tip end portion 34 side, as compared with the case where the value Lt/r is maximum at a position where the dimensionless span length exceeds 0.65. Therefore, with the turbine rotor blade 3 according to some embodiments, it is possible to suppress loss in the turbine 30.

Therefore, in the turbine 30 having the turbine rotor blade 3 according to some embodiments, it is possible to suppress loss.

Figure 6:
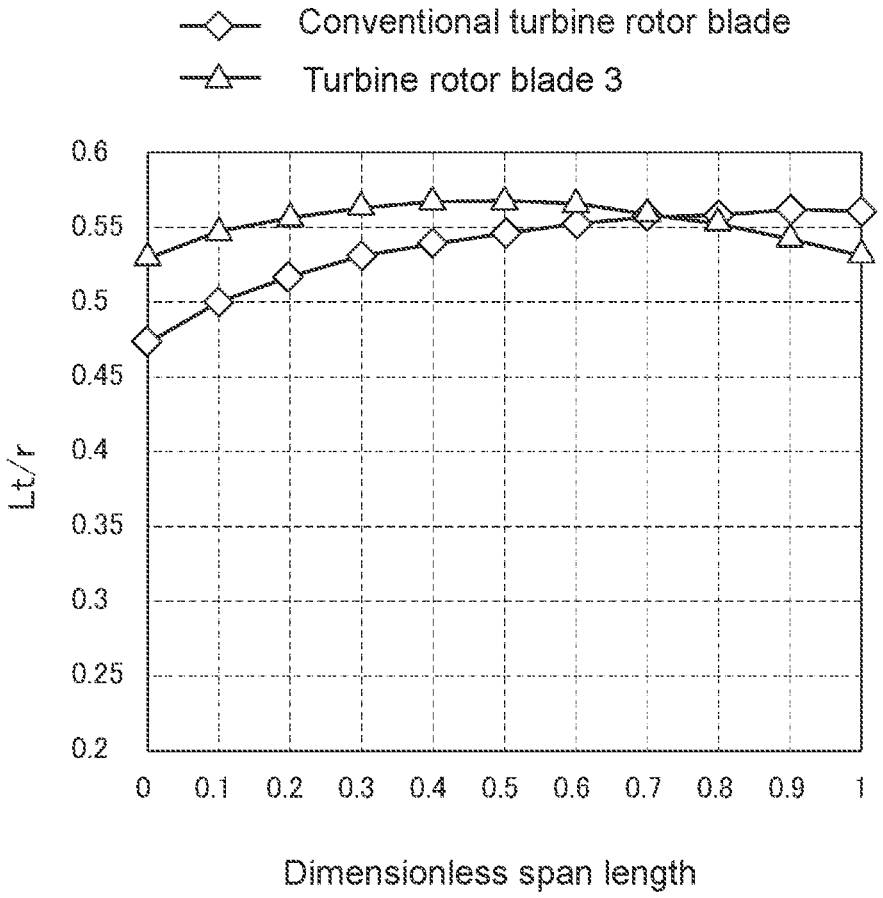
FIG. 6 is a diagram comparing the value Lt/r of a conventional turbine rotor blade with the value Lt/r of a turbine rotor blade according to some embodiments.

FIG. 6 is a diagram comparing the value Lt/r of a conventional turbine rotor blade with the value Lt/r of the turbine rotor blade 3 according to some embodiments. In FIG. 6, the vertical axis represents the Lt/r value, and the horizontal axis represents the dimensionless span length. In FIG. 6, rectangular plots represent the Lt/r value of the conventional turbine rotor blade, and the triangular plots represent the Lt/r value of the turbine rotor blade 3 according to some embodiments.

The conventional turbine rotor blade of FIG. 6 includes the rotor blade having a shape in which the range RA is cut out from the turbine rotor blade 3 for example shown in FIG. 2. In other words, the turbine rotor blade 3 of FIG. 6 includes the rotor blade 33 having a shape in which a portion shown by the range RA is added to the trailing edge of the conventional turbine rotor blade. That is, the conventional turbine rotor blade of FIG. 6 is the same as the conventional turbine rotor blade of FIG. 4. Further, the turbine rotor blade 3 of FIG. 6 is the same as the turbine rotor blade 3 of FIG. 4.

As shown in FIG. 6, in the conventional turbine rotor blade, the Lt/r value is maximum when the dimensionless span length is close to 1, while in the turbine rotor blade 3 of FIG. 6, the Lt/r value is maximum when the dimensionless span length is around 0.4 to 0.5.

Further, for example in the turbine rotor blade 3 according to some embodiments, as described below, the rotor blade 33 is formed such that a value (l/L) obtained by dividing l by a distance L ranges from 0.3 to 0.65.

l is expressed by the following expression (1).

$$l=D\times\sin\{360/(n\times2)\}\times\sin\beta1 \quad (1)$$

In the expression, β1 is a blade angle β [degree] at an end P3 on the tip end portion 34 side of the trailing edge 37 of the rotor blade 33. D is a diameter of the turbine rotor blade 3 at the end P3. n is the number of the rotor blades.

L is a distance between the end P3 and an end P4 on the tip end portion 34 side of the leading edge 36 of the rotor blade 33. That is, L is a chord length of the tip end portion 34 of the rotor blade 33.

Figure 7:
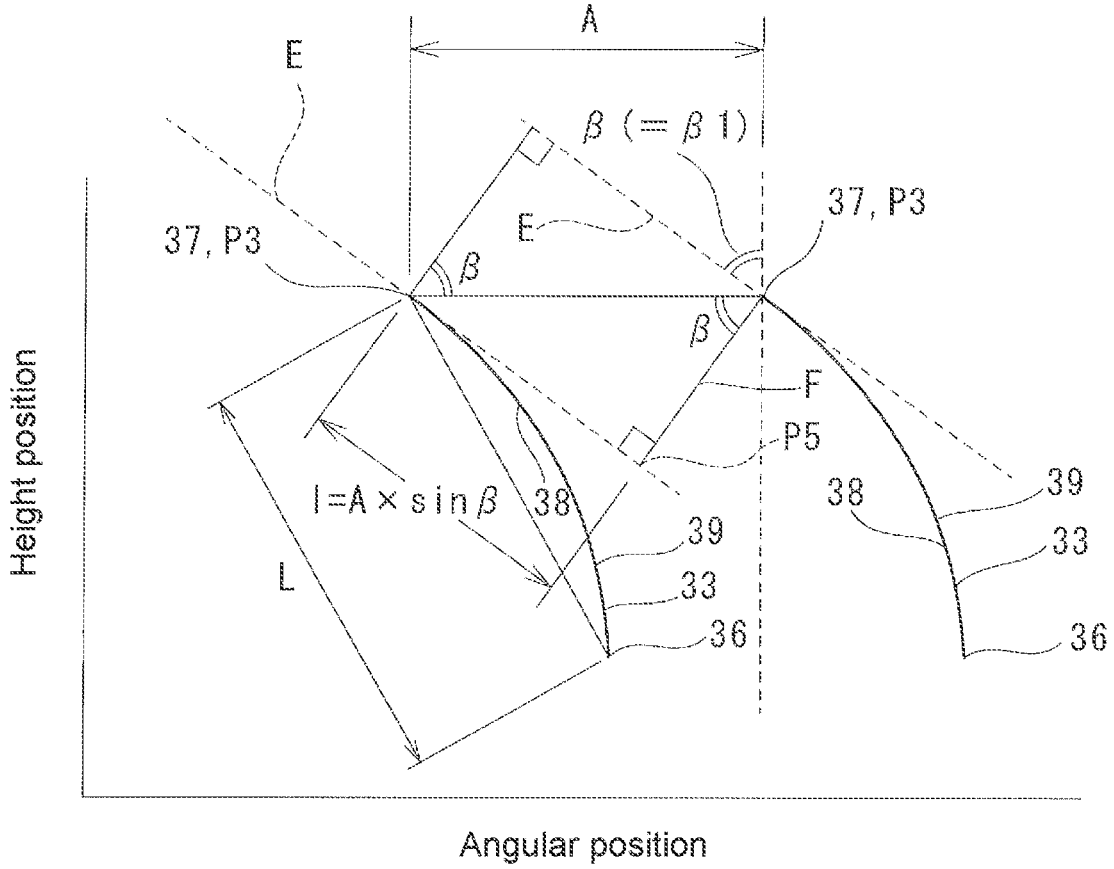
FIG. 7 is a circumferential development view of a tip end portion of a rotor blade, where the horizontal axis represents the angular position about the axis of the turbine rotor blade, and the vertical axis represents the height position along the axis of the turbine rotor blade.

With reference to FIG. 7, 1 will be described. FIG. 7 is a circumferential development view of the tip end portion 34 of the rotor blade 33, where the horizontal axis represents the angular position about the axis AX of the turbine rotor blade 3, and the vertical axis represents the height position along the axis AX of the turbine rotor blade 3.

As shown in FIG. 7, 1 corresponds to a distance between two points on a straight line E described below. The straight line E is a line that passes through the end P3 on the tip end portion 34 side of the trailing edge 37 of one rotor blade 33 and extends at the same angle as β1 [degree], which is the blade angle β at the end P3, when the rotor blade 33 is viewed from the radially outer side. One of the two points is the end P3, and the other is an intersection P5 between the straight line E and a perpendicular line F from the end P3 on the tip end portion 34 side of the trailing edge 37 of another rotor blade 33 adjacent to the suction side (suction surface 39) of the one rotor blade 33 to the straight line E.

As is apparent from FIG. 7, l is a product (A×sin β1) of a linear distance A between the ends P3 of the trailing edges 37 of two adjacent rotor blades 33 on the tip end portion 34 side and sin β1.

The distance A can also be calculated by the following expression (2).

$$A=D\times\sin\{360/(n\times2)\} \quad (2)$$

It means that the smaller the value represented by l/L, the closer the formation position of the throat portion 41 to the trailing edge 37.

Therefore, in the above-described embodiments, since the value represented by l/L ranges from 0.3 to 0.65, the formation position of the throat portion 41 is closer to the trailing edge 37 than when the value exceeds 0.65. When the formation position of the throat portion 41 is close to the trailing edge 37, the difference in chordwise position between the first position P1 of one rotor blade 33A and the second position P2 of the other rotor blade 33B that form the throat portion 41 decreases. As a result, the difference between the blade angle β at the first position P1 and the blade angle β at the second position P2, i.e., the difference between the blade angle β of one rotor blade 33A and the blade angle β of the other rotor blade 33B in the throat portion 41 decreases, so that the increase in blade-to-blade distance Lt in the throat portion 41 is suppressed.

Therefore, in the above-described embodiments, it is possible to reduce the flow rate of a working fluid (exhaust gas) on the tip 34 side. Thus, it is possible to suppress loss in the turbine 30.

In some embodiments, in the range RA between the trailing edge 37 and a position 51 away from the trailing edge 37 toward the leading edge 36 by a predetermined length (for example, length of 20% or less of chord length) along the chordwise direction, the rotor blade 33 may have a region where the blade β is constant regardless of the chordwise direction.

In the case where the throat portion 41 is formed close to the trailing edge 37 of the rotor blade 33, by providing the region where the blade angle β is constant regardless of the chordwise position in the range RA, it is possible to reduce the difference between the blade angle β of one rotor blade 33A and the blade angle of the other rotor blade 33B in the throat portion 41, as compared with the case where this region is not provided. Therefore, it is possible to suppress an increase in blade-to-blade distance Lt in the throat portion 17 and reduce the flow rate of a working fluid (exhaust gas) on the tip 34 side. Thus, it is possible to suppress loss in the turbine 30.

In some embodiments, the number of the rotor blades 33 may be not more than 12.

As described above, when the number of the rotor blades 33 is reduced, the blade-to-blade distance between two adjacent rotor blades 33 increases, so that the blade-to-blade distance Lt also increases in the throat portion 41 where the blade-to-blade distance is the smallest. Further, as the number of the rotor blades 33 is reduced, the load applied on one rotor blade increases, and the flow rate of a working gas increases, so that the influence of the leak flow on the tip 34 side relatively increases.

In this regard, when the feature of the turbine rotor blade 3 according to the above-described embodiments is applied to the turbine rotor blade 3 having a relatively small number of, namely 12 or less, rotor blades 33, the effect of suppressing the loss in the turbine 30 is remarkable.

The turbine 30 according to some embodiments may include a variable nozzle mechanism 60 for adjusting a flow of a working fluid to the turbine rotor blade 3.

Figure 8:
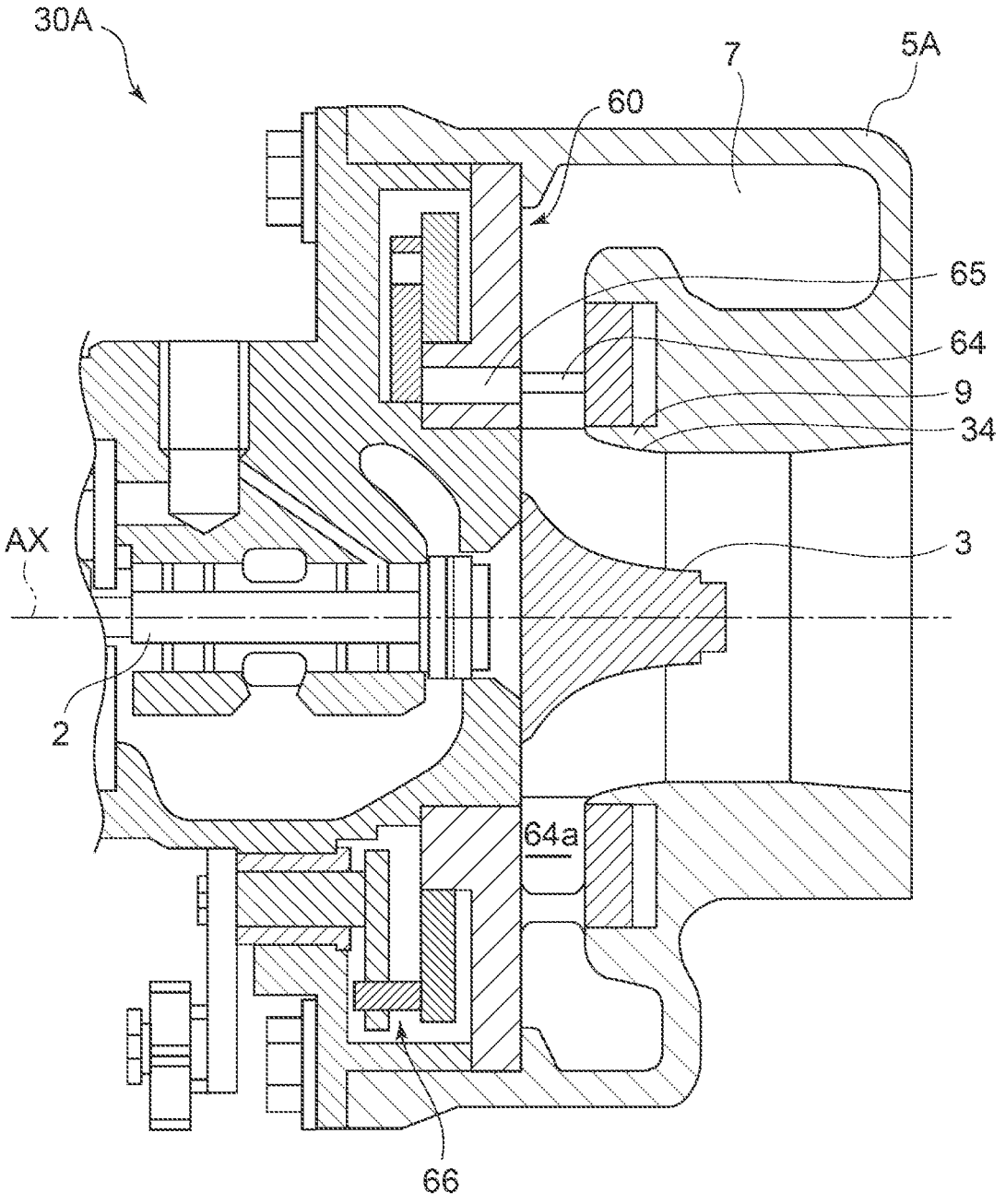
FIG. 8 is a cross-sectional view of a variable geometry turbine including a variable nozzle mechanism according to an embodiment.

FIG. 8 is a schematic cross-sectional view of a turbine of a variable-displacement type (variable geometry turbine) including a variable nozzle mechanism according to an embodiment.

As shown in FIG. 8, the variable geometry turbine 30A according to an embodiment includes the turbine rotor blade 3 according to the above-described embodiments, a casing (turbine housing) 5A rotatably accommodating the turbine rotor blade 3, and a variable nozzle mechanism 60 for controlling the flow direction of a working fluid flowing toward the turbine rotor blade 3.

In the embodiment shown in FIG. 8, the variable nozzle mechanism 60 includes a nozzle vane 64. In the embodiment shown in FIG. 8, a plurality of nozzle vanes 64 are arranged at intervals in the circumferential direction. Between adjacent nozzle vanes 64, a nozzle flow passage 64*a* is formed. The nozzle vane 64 is configured to change the blade angle in response to rotation of a nozzle shaft 65 about the axis by a driving mechanism 66.

In the variable geometry turbine 30A having the variable nozzle mechanism 60, the flow rate range of the working fluid is wide, and the number of blades is small, compared with the non-variable geometry turbine 30.

In this regard, in the variable geometry turbine 30A according to an embodiment having the turbine rotor blade 3 according to the above-described embodiments, the effect of suppressing loss in the variable geometry turbine 30A is remarkable.

The present invention is not limited to the embodiments described above, but includes modifications to the embodiments described above, and embodiments composed of combinations of those embodiments.

REFERENCE SIGNS LIST

1 Turbocharger
3 Turbine wheel (Turbine rotor blade)
5 Casing (Turbine housing)
30 Turbine
30A Variable geometry turbine
31 Hub
32 Hub surface
33 Rotor blade
34 (Tip end portion) Tip
35 Root end portion
36 Leading edge
37 Trailing edge
41 Throat portion
60 Variable nozzle mechanism

The invention claimed is:

1. A turbine rotor blade to be connected to a rotational shaft so as to be rotatable around an axis, comprising:

a hub having a hub surface inclined with respect to the axis in a cross-section along the axis; and a plurality of rotor blades disposed on the hub surface, wherein, in a throat portion where a blade-to-blade distance between two adjacent rotor blades of the plurality of rotor blades is smallest, a value (Lt/r) obtained by dividing the blade-to-blade Lt at a given radial position by a distance r from the axis to the radial position is maximum at a position where a dimensionless span length is in a range of 0.2 to 0.65, assuming that the dimensionless span length is 0 at a position of a root end portion on a hub side, and the dimensionless span length is 1 at a position of a tip end portion opposite to the hub side.

2. A turbine rotor blade to be connected to a rotational shaft so as to be rotatable around an axis, comprising:

a hub having a hub surface inclined with respect to the axis in a cross-section along the axis; and a plurality of rotor blades disposed on the hub surface, wherein when l is expressed by the following expression (1):

$$l=D\times\sin\{360/(n\times2)\}\times\sin\beta \quad (1),$$

where β is a blade angle [degree] at a tip-side end of a trailing edge of each rotor blade, D is a diameter of the turbine rotor blade at the tip-side end, and n is the number of the rotor blades, a value (l/L) obtained by dividing l by a distance L between the tip-side end of the trailing edge and a tip-side end of a leading edge of the rotor blade ranges from 0.3 to 0.65.

3. The turbine rotor blade according to claim 1, wherein the plurality of rotor blades has a region where a blade angle is constant regardless of a position in a chordwise direction in a range between a trailing edge and a position away from the trailing edge toward a leading edge by a predetermined length along the chordwise direction.

4. The turbine rotor blade according to claim 1, wherein the number of the rotor blades is not more than 12.

5. A turbine, comprising:

the turbine rotor blade according to claim 1; and a casing rotatably accommodating the turbine rotor blade.

6. The turbine according to claim 5, further comprising a variable nozzle mechanism for adjusting a flow of a working fluid to the turbine rotor blade.

7. The turbine rotor blade according to claim 2, wherein the plurality of rotor blades has a region where a blade angle is constant regardless of a position in a chordwise direction in a range between a trailing edge and a position away from the trailing edge toward a leading edge by a predetermined length along the chordwise direction.

8. The turbine rotor blade according to claim 2, wherein the number of the rotor blades is not more than 12.

9. A turbine, comprising:

the turbine rotor blade according to claim 2; and a casing rotatably accommodating the turbine rotor blade.

10. The turbine according to claim 9, further comprising a variable nozzle mechanism for adjusting a flow of a working fluid to the turbine rotor blade.

* * * * *